US007834533B2

(12) United States Patent
Jansma

(10) Patent No.: US 7,834,533 B2
(45) Date of Patent: Nov. 16, 2010

(54) T8 FLUORESCENT LAMP

(75) Inventor: Jon B. Jansma, Pepper Pike, OH (US)

(73) Assignee: General Electric Company, Schenectady, NY (US)

( * ) Notice: Subject to any disclaimer, the term of this patent is extended or adjusted under 35 U.S.C. 154(b) by 372 days.

(21) Appl. No.: 12/038,385

(22) Filed: Feb. 27, 2008

(65) Prior Publication Data

US 2009/0213584 A1 Aug. 27, 2009

(51) Int. Cl.
*H01J 1/62* (2006.01)

(52) U.S. Cl. ..... 313/486; 313/643; 313/573; 313/634

(58) Field of Classification Search ..... None
See application file for complete search history.

(56) References Cited

U.S. PATENT DOCUMENTS

| | | | | |
|---|---|---|---|---|
| 3,501,662 | A | 3/1970 | Plagge | |
| 3,898,511 | A | 8/1975 | Johnson et al. | |
| 4,075,532 | A | 2/1978 | Piper et al. | |
| 5,059,860 | A | 10/1991 | Sato et al. | |
| 5,471,113 | A | 11/1995 | Debacker et al. | |
| 5,602,444 | A | 2/1997 | Jansma | |
| 5,714,836 | A * | 2/1998 | Hunt et al. | 313/487 |
| 5,838,100 | A | 11/1998 | Jansma | |
| 5,944,572 | A | 8/1999 | Soules et al. | |
| 6,121,629 | A | 9/2000 | Koishikawa et al. | |
| 6,400,097 | B1 | 6/2002 | Jin et al. | |
| 6,452,324 | B1 | 9/2002 | Soules et al. | |
| 6,525,460 | B1 | 2/2003 | Soules et al. | |
| 6,528,938 | B1 | 3/2003 | Jansma | |
| 6,583,566 | B1 | 6/2003 | Jin et al. | |
| 6,650,042 | B2 | 11/2003 | Hammer | |
| 6,841,939 | B2 * | 1/2005 | Scott et al. | 313/642 |
| 6,965,193 | B2 | 11/2005 | Srivastava et al. | |
| 6,992,432 | B1 | 1/2006 | Jansma | |

(Continued)

FOREIGN PATENT DOCUMENTS

| | | | |
|---|---|---|---|
| EP | 0594424 | A | 4/1994 |

(Continued)

OTHER PUBLICATIONS

Office Action dated Mar. 4, 2010 for U.S. Appl. No. 11/606,689, filed Nov. 30, 2006.

*Primary Examiner*—Ashok Patel
(74) *Attorney, Agent, or Firm*—Pearne & Gordon LLP

(57) ABSTRACT

A T8 fluorescent lamp can comprise a light-transmissive glass envelope, means for providing an electrical discharge to the glass envelope, a phosphor layer within the glass envelope and a discharge-sustaining fill gas inside the glass envelope. The phosphor layer can comprise phosphors of a type for producing a daylight lighting spectrum or of a type for producing a tungsten/halogen lighting spectrum. The fill gas can comprise a mixture of argon and neon. In a particular mode of operation, the T8 lamp can operate at a power of at least 45 watts. In another mode of operation, the T8 fluorescent lamp can operate at a power of approximately 70 watts. A lighting fixture can comprise an array of such T8 fluorescent lamps arranged substantially side-to-side on longitudinal centerlines that are less than one and one-half inches apart. In a particular instance, the fixture can have been retrofitted from having been outfitted to accommodate T12 lamps.

23 Claims, 1 Drawing Sheet

U.S. PATENT DOCUMENTS

| | | | |
|---|---|---|---|
| 2003/0184239 | A1 | 10/2003 | Myojo et al. |
| 2004/0113538 | A1 | 6/2004 | Srivastava et al. |
| 2004/0160766 | A1 | 8/2004 | Schultz |
| 2004/0232820 | A1 | 11/2004 | Jansma |
| 2005/0236959 | A1 | 10/2005 | Toth et al. |
| 2007/0170834 | A1 | 7/2007 | Jansma |
| 2007/0170863 | A1 * | 7/2007 | Jansma ..... 313/567 |

FOREIGN PATENT DOCUMENTS

| | | | |
|---|---|---|---|
| EP | 1813661 | A2 | 8/2007 |
| GB | 24083872 | | 5/2005 |
| JP | 04319246 | | 11/1992 |

* cited by examiner

T8 FLUORESCENT LAMP

BACKGROUND OF THE INVENTION

This invention relates generally to fluorescent lamps and more particularly to T8 fluorescent lamps that can be operated at increased power levels.

T8 fluorescent lamps have found widespread acceptability in the North American market for a variety of applications. The designation "T8" is indicative of the fact that the lamps have a nominal outer diameter of one inch. That is to say that the outer diameter of the lamp (one inch) is equal to eight increments of one-eighth inch each. Typically, T8 lamps are linear in shape and have a length of forty-eight inches, although the lamps can be nonlinear and have lengths other than forty-eight inches. Thus, T8 lamps can be circular or otherwise curvilinear in shape and be two, three, six or eight feet in length for example.

Commercially available T8 fluorescent lamps in their variety of applications are commonly operated at wattage or power levels of less than about thirty-five watts. Examples of T8 fluorescent lamps operated at such power levels are disclosed in U.S. Pat. Nos. 6,400,097, 6,650,042 and 6,583,566. There are, however, certain applications such as, for example, applications at stage and studio environments where commercially available T8 fluorescent lamps operated at such power levels do not satisfy all the lighting requirements that pertain to those environments.

SUMMARY OF THE INVENTION

The following presents a simplified summary of the invention in order to provide a basic understanding of examples of aspects of the invention. The summary is not an extensive overview of the invention. Moreover, the summary is not intended to identify critical elements of the invention nor delineate the scope of the invention. The sole purpose of the summary is to present certain concepts of the invention in simplified form as a prelude to the more detailed description that follows.

According to one aspect of the invention, a T8 fluorescent lamp can comprise a light-transmissive glass envelope having an inner surface, means for providing an electrical discharge to the interior of the glass envelope, a phosphor layer within the interior of the glass envelope and a discharge-sustaining fill gas sealed inside the light-transmissive glass envelope. The phosphor layer can comprise one or more phosphors selected from the group consisting of phosphors for producing a daylight lighting spectrum and phosphors for producing a tungsten/halogen lighting spectrum. In addition, the discharge-sustaining fill gas can comprise a mixture of argon and neon. In a particular case, the T8 lamp can operate at a power of at least 45 watts. In another particular case, the T8 fluorescent lamp can operate at a power of approximately 70 watts.

According to another aspect, a T8 fluorescent lamp as described in the previous paragraph can have a phosphor layer comprising one or more phosphors for producing a daylight lighting spectrum having a nominal correlated color temperature of 5500K. In another aspect, the T8 lamp can have a phosphor layer comprising one or more phosphors for producing a tungsten/halogen lighting spectrum having a nominal correlated color temperature of 3200K.

According to still another aspect, the fill gas of the T8 fluorescent lamp can comprise a mixture of 50% neon and 50% argon by volume. And in a particular instance, the fill gas pressure within the glass envelope can be approximately 2.0 torr.

According to still a further aspect, a barrier layer can be located between the inner surface of the glass envelope and the phosphor layer within the interior of the glass envelope of the T8 fluorescent lamp, the barrier layer being effective to reflect ultraviolet light back to the phosphor layer. In a particular instance, the barrier layer can comprise a blend of gamma alumina and alpha alumina.

According to yet another aspect, the T8 fluorescent lamp can have a nominal life of at least 2,000 hours.

According to still a further aspect, the T8 fluorescent lamp can be mounted in a light fixture that is located at either a stage environment or a studio environment.

According to another aspect, a lighting fixture can comprise an array of linear T8 fluorescent lamps as described in the foregoing paragraphs that are arranged substantially side-to-side on longitudinal centerlines that are less than one and one-half inches apart. In a particular case, the fixture can have been retrofitted from having had lamp holders spaced to accommodate T12 lamps that have an outer diameter of one and one-half inches.

According to yet a further aspect, a process for lighting an area such as a stage environment or a studio environment for example can comprise providing at least one of the T8 fluorescent lamps as described above and operating the at least one T8 fluorescent lamp at a preselected power level. In a particular case, the T8 fluorescent lamp can be operated at a power of at least 45 watts. In another particular case, the T8 fluorescent lamp can be operated at a power level of approximately 70 watts.

DETAILED DESCRIPTION OF EMBODIMENTS OF THE INVENTION

Figure 1:
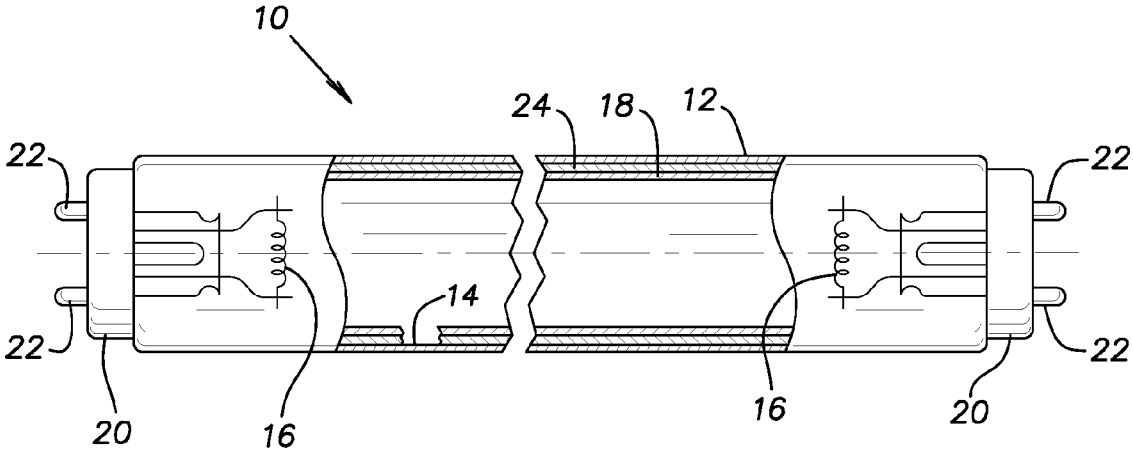
FIG. 1 is a somewhat schematic illustration, partly in cross-section, of a T8 fluorescent lamp according to one embodiment of the invention.

FIG. 1 shows a T8 fluorescent lamp, indicated generally at 10. The lamp includes a light-transmissive glass tube or envelope 12 having an inner surface 14, means 16 for providing an electrical discharge to the interior of the glass envelope 12, a phosphor layer 18 within the interior of the glass envelope 12 and a discharge-sustaining fill gas comprising a mixture of argon and neon sealed inside the light-transmissive glass envelope. The glass tube 12 has a circular cross-section with a diameter of one inch. As described above, the one-inch diameter is the basis for the ascription of the "T8" designation to the lamp 10. Also as described above, the lamp 10 can have a variety of lengths such as, for example, two, three, four, six and eight feet.

The lamp is hermetically sealed by the bases 20 attached at both ends of the glass tube 12, and a pair of spaced electrode structures 16 comprise the means for providing an electrical discharge to the interior of the glass envelope 12 when an electric current is applied to the electrode structures. As will be familiar to those having ordinary skill in the art, the electric current is delivered to the electrode structures through the pins 22 which are held in lamp sockets or holders not shown that are connected to an electric circuit that includes a source of electric power.

The T8 fluorescent lamps of the invention are intended to be used where it is desired to be able to provide variable quantities of a daylight lighting spectrum or a tungsten/halogen lighting spectrum. By the terminology "daylight lighting spectrum" what is meant is light that simulates the visible spectrum of natural light, i.e., light that simulates daylight. And by the terminology "tungsten/halogen lighting spectrum" what is meant is light that has a preponderance of electromagnetic radiation in the red portion of the visible light spectrum. An example of a daylight lighting spectrum is light from the lamp that has a correlated color temperature of nominally 5500K. And an example of a tungsten/halogen lighting spectrum is light from the lamp that has a correlated color temperature of nominally 3200K.

Two examples of particular phosphor blends used in the fluorescent lamps to produce a daylight lighting spectrum and a tungsten/halogen lighting spectrum, respectively, are as follows:

Daylight Lighting Spectrum

1) Red: tin-doped strontium phosphate (strontium red)
   Blue #1: strontium/barium chlorapatite doped with europium (SECA)
   Blue #2: barium chlorapatite doped with europium (BECA)
2) Red: tin-doped strontium phosphate (strontium red)
   Blue: manganese free halophosphor (blue halo)

Tungsten/Halogen Lighting Spectrum

1) Red: tin-doped strontium phosphate (strontium red)
   Red #2: Magnesium fluorogerminate
   Green: lanthanum phosphate doped with terbium and cesium
   Blue: barium chlorapatite doped with europium (BECA)
2) Red: tin-doped strontium phosphate (strontium red)
   Green: zinc silicate
   Blue: europium-doped strontium aluminate (SAE)

The blending of the phosphors of each of these respective formulations in quantities to provide correlated color temperatures of nominally 3200K, in the case of the tungsten/halogen lighting spectrum, and nominally 5500K, in the case of the daylight lighting spectrum, is within the capabilities of those having ordinary skill in the art.

The quantity of a daylight lighting spectrum or a tungsten/halogen lighting spectrum provided in any particular circumstance can be controlled by controlling the power at which the T8 fluorescent lamp is operated. Such control can be provided by a dimming feature such as is available using currently available electronic ballast technology familiar to those having ordinary skill in the art. These ballasts provide the required starting voltage for the lamp and then control the subsequent flow of electric current to the lamp. An example of such ballast is a typical 54 watt T5 ballast familiar to those having ordinary skill in the art. Stable, efficient dimming is available with the T8 fluorescent lamps of the invention using such ballasts.

The ability to vary the amount of light generated is particularly desirable in connection with the lighting of a stage or studio environment. Using the T8 fluorescent lamps of the invention, large amounts of daylight light or tungsten/halogen light can be generated by operating the T8 fluorescent lamps at a power of least 45 watts. For applications where particularly significant quantities of light are desired, the T8 fluorescent lamps can be operated at a power of approximately 70 watts or more, such as 80 to 95 watts. At 70 watts, the T8 fluorescent lamps of the invention can provide approximately twice the light level provided when the lamps are operated at the more typical operating level of approximately 32 watts.

The reference to the T8 fluorescent lamps of the invention being used in a stage environment or a studio environment, such as where the lamps can be mounted in a light fixture located at one of a stage environment and a studio environment, highlights the particular usefulness of the lamps of the invention in those environments. By the terminology "stage environment" what is meant is an environment where theatrical performances and the like for example are performed. And by the terminology "studio environment" what is meant is an environment where filming such as on movie sets or photographic studios is done, where the broadcasting of live activities for television and the like are carried out or where artistic activities such as painting and the like are conducted, for example.

The T8 fluorescent lamps of the invention in addition to possessing the advantageous features discussed above, demonstrate good warm-up properties, good thermal stability and softness and the ability to maintain no more than a two-hundred to three-hundred degrees variance or shift in the correlated color temperature at the correlated color temperatures of 3200K and 5500K over operating power levels ranging from approximately 28 watts to approximately 57 watts. However, operating power levels in the range of 0.1 watt to 95 watts can be used depending on the requirements that are applicable in any particular instance of use of the lamps.

Another feature of the T8 fluorescent lamps of the invention concerns their loss of efficiency as measured by lumens per watt when operated at high power levels due to the increased temperatures and discharge losses that typically can accompany such operation. In this connection, the T8 fluorescent lamps of the invention having correlated color temperatures of 3200K and the T8 fluorescent lamps of the invention having correlated color temperatures of 5500K can exhibit a total variation in efficiency of less than approximately 2.5 lumens per watt over an operating power range of approximately 32 watts to approximately 95 watts.

The features of the T8 fluorescent lamps of the invention discussed above can be realized using a fill gas comprising a mixture of neon and argon at a pressure of approximately 2.0 torr. In particular, a fill gas mixture comprising 50% argon and 50% neon by volume can be used. Improved lamp efficiency in the form of the generation of increased lumens per watt and reduced glass envelope temperatures can result using mixtures of argon and neon as the fill gas. Also, pressures of approximately 2.0 torr for the argon/neon fill gas mixtures can provide increased lumens per watt. It will be understood by those having ordinary skill in the art that the lamps can also contain mercury vapor in which an electric arc is established for starting the lamp when the lamp electrodes are energized.

T8 fluorescent lamps manufactured in accordance with the teachings hereof can have nominal lives of at least 2,000 hours notwithstanding their operation at a power level of approximately 70 watts based on a three-hour on, twenty-minute off cycle.

To support the ability of the T8 fluorescent lamps of the invention to operate at higher power levels, electrodes rated for high current levels and exhibiting good dimming control and life and not subject to excessive end discoloration can be used. Standard triple coil electrodes and stick electrodes typically used in T8 fluorescent lamps that are operated at power levels of 32 watts can be employed.

The T8 fluorescent lamps of the invention can be provided with a barrier layer as indicated at 24 in the embodiment of FIG. 1 located between the inner surface 14 of the glass envelope 12 and the phosphor layer 18 within the interior of the glass envelope, although such a barrier layer is not required. The barrier layer is effective to reflect ultraviolet light back to the phosphor layer and enhance the quantity of light generated by the lamp. The provision of such barrier layers can be accomplished as discussed in U.S. Pat. No. 5,602,444, the content of which is incorporated herein by reference thereto. As disclosed in that patent, the barrier layer can comprise a blend of gamma aluminum and alpha aluminum. In addition to enhancing the quantity of light generated by the lamp, the barrier layer can increase the softness of the light from the lamp.

Figure 2:
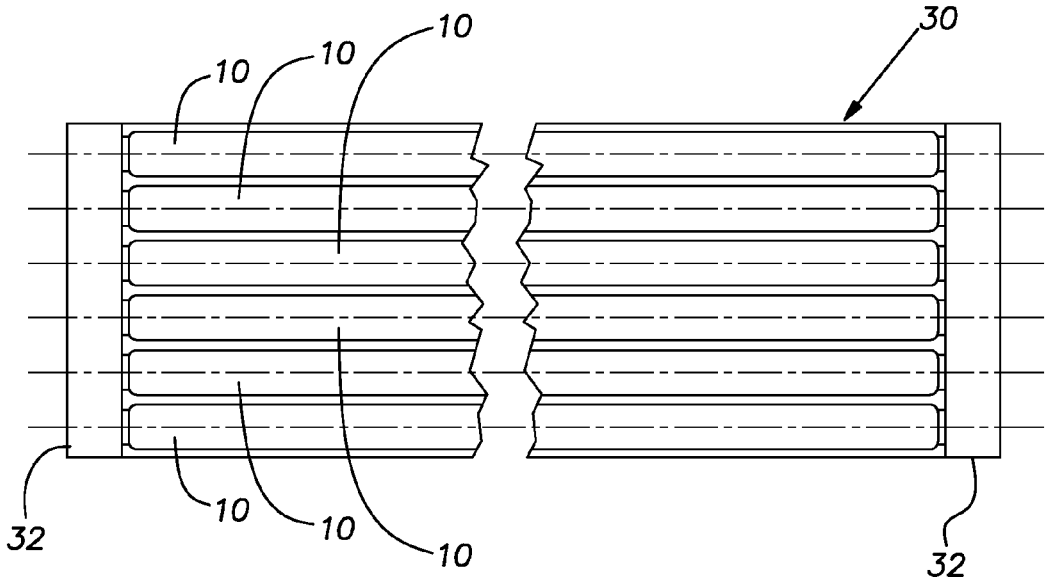
FIG. 2 is a somewhat schematic illustration of a second embodiment of the invention wherein the T8 fluorescent lamps of the invention are shown installed in a light fixture.

The T8 fluorescent lamps of the invention can be particularly applied to lighting fixtures previously outfitted to use T12 fluorescent lamps in a stage environment or a studio environment. In such instances, a fixture can be retrofitted so that the lamp holders or sockets can receive the T8 lamps in close proximity to one another. An example of such an arrangement is shown in FIG. 2. There, the light fixture, indicated generally at 30, has been retrofitted from holding T12 lamps to holding a close-packed planar array of T8 fluorescent lamps 10 arranged substantially side-to-side. In other words, the lamp holders or lamp sockets 32 of the fixture 30 have been reconfigured so as to be able to accommodate the closely spaced array of linear T8 fluorescent lamps 10 that are arranged on longitudinal centerlines that are spaced apart by less than one and one-half inches. The one and one-half inch dimension, of course, is the smallest dimension that could be provided for T12 lamps, which have an outside diameter of one and one-half inches, if the T12 lamps were arranged so as to abut one another. Because, the T8 fluorescent lamps are arranged along centerlines that are less than one and one-half inches apart, a greater number of T8 lamps can be installed in the retrofitted fixture 30. Thus, the one-third reduction in lamp diameter between T12 lamps and T8 lamps allows for the addition of approximately 50% more lamps in a fixture of a given size such as in the fixture of FIG. 3. For that reason alone, a greater amount of light can be provided by the retrofitted fixture 30 than would be available if the fixture were outfitted to accommodate T12 lamps. And as discussed above, operating the T8 fluorescent lamps 10 at a power of at least 45 watts, such as 70 watts, can provide the additional amounts of light required in connection with activities that occur at a stage environment or studio environment.

While the embodiment of FIG. 2 includes six T8 fluorescent lamps, the concepts of the present invention can be applied to lighting fixtures of various sizes incorporating any number of T8 lamps.

From the foregoing descriptions, it will be understood that an aspect of the invention includes a process for lighting an area such as one of a stage environment and a studio environment. The process comprises providing at least one T8 fluorescent lamp including a light-transmissive glass envelope having an inner surface, means for providing an electrical discharge to the interior of the glass envelope, a phosphor layer within the interior of the glass envelope, the phosphor layer comprising one or more phosphors selected from the group consisting of phosphors for producing a daylight lighting spectrum and phosphors for producing a tungsten/halogen lighting spectrum, and a discharge-sustaining fill gas comprising a mixture of argon and neon sealed inside the light-transmissive glass envelope and operating the at least one T8 fluorescent lamp at a preselected power level. The preselected power level can be at least 45 watts, and include a power level of at least 70 watts or more.

Although the present invention has been described with reference to the drawings wherein particular embodiments are illustrated and with reference to particular aspects identified in the specification, it will be understood by those having ordinary skill in the art that various changes may be made to and equivalents may be substituted for the elements, components and features described without departing from the scope of the invention. Therefore, it is intended that the scope of the invention not be limited to the particular embodiments and aspects described but that the invention include all embodiments and aspects encompassed within the scope of the appended claims.

What is claimed is:

1. A T8 fluorescent lamp including a light-transmissive glass envelope having an inner surface, means for providing an electrical discharge to the interior of the glass envelope, a phosphor layer within the interior of the glass envelope in which there is at most one green emitting phosphor component, the phosphor layer comprising one or more phosphors selected from the group consisting of phosphors for producing a daylight lighting spectrum and phosphors for producing a tungsten/halogen lighting spectrum, and a discharge-sustaining fill gas comprising a mixture of argon and neon sealed inside the light-transmissive glass envelope, wherein the lamp has a variance in correlated color temperature of not more than 300 degrees over an operating power level ranging from approximately 28 watts to approximately 57 watts .

2. The T8 fluorescent lamp of claim 1 wherein the lamp operates at a power of at least 45 watts.

3. The T8 fluorescent lamp of claim 1 wherein the lamp operates at a power of approximately 70 watts.

4. The T8 fluorescent lamp of claim 1 wherein the phosphor layer comprises one or more phosphors for producing a daylight lighting spectrum having a nominal correlated color temperature of approximately 5500K.

5. The T8 fluorescent lamp of claim 1 wherein the phosphor layer comprises one or more phosphors for producing a tungsten/halogen lighting spectrum having a nominal correlated color temperature of approximately 3200K.

6. The T8 fluorescent lamp of claim 1 wherein the fill gas comprises a mixture of 50% neon and 50% argon by volume.

7. The T8 fluorescent lamp of claim 6 wherein the fill gas pressure within the glass envelope is approximately 2.0 torr.

8. The T8 fluorescent lamp of claim 1 including a barrier layer located between the inner surface of the glass envelope and the phosphor layer within the interior of the glass envelope, the barrier layer being effective to reflect ultraviolet light back to the phosphor layer.

9. The lamp of claim 1 wherein said variance in correlated color temperature is not more than 200 degrees across said operating power level.

10. The T8 fluorescent lamp of claim 1 wherein the lamp has a nominal life of at least 2,000 hours.

11. The T8 fluorescent lamp of claim 1 wherein the lamp is mounted in a light fixture that is located at one of a stage environment and a studio environment.

12. A T8 fluorescent lamp including a light-transmissive glass envelope having an inner surface, means for providing an electrical discharge to the interior of the glass envelope, a phosphor layer within the interior of the glass envelope, the phosphor layer comprising one or more phosphors selected from the group consisting of phosphors for producing a daylight lighting spectrum and phosphors for producing a tungsten/halogen lighting spectrum, and a discharge-sustaining fill gas comprising a mixture of argon and neon sealed inside the light-transmissive glass envelope, including a barrier layer located between the inner surface of the glass envelope and the phosphor layer within the interior of the glass envelope, the barrier layer being effective to reflect ultraviolet light back to the phosphor layer, wherein the barrier layer comprises a blend of gamma alumina and alpha alumina.

13. A lighting fixture comprising an array of linear T8 fluorescent lamps arranged substantially side-to-side on longitudinal centerlines that are less than one and one-half inches apart, each T8 fluorescent lamp including a light-transmissive glass envelope having an inner surface, means for providing an electrical discharge to the interior of the glass envelope, a phosphor layer within the interior of the glass envelope in which there is at most one green emitting phosphor component, the phosphor layer comprising one or more phosphors selected from the group consisting of phosphors for producing a daylight lighting spectrum and phosphors for producing a tungsten/halogen lighting spectrum, and a discharge-sustaining fill gas comprising a mixture of argon and neon sealed inside the light-transmissive glass envelope, wherein each of the lamps has a variance in correlated color temperature of not more than 300 degrees over an operating power level ranging from approximately 28 watts to approximately 57 watts.

14. The lighting fixture of claim 13 wherein each of the T8 fluorescent lamps operates at a power of approximately 70 watts.

15. The lighting fixture of claim 13 wherein the fixture is located at one of a stage environment and a studio environment.

16. The lighting fixture of claim 13 wherein the fixture has been retrofitted from having lamp holders spaced to accommodate T12 lamps.

17. The lighting fixture of claim 12 wherein each of the T8 fluorescent lamps operates at a power of at least 45 watts.

18. The lighting fixture of claim 13 wherein said variance in correlated color temperature is not more than 200 degrees across said operating power level.

19. A process for lighting an area comprising:

providing at least one T8 fluorescent lamp including a light-transmissive glass envelope having an inner surface, means for providing an electrical discharge to the interior of the glass envelope, a phosphor layer within the interior of the glass envelope in which there is at most one green emitting phosphor component, the phosphor layer comprising one or more phosphors selected from the group consisting of phosphors for producing a daylight lighting spectrum and phosphors for producing a tungsten/halogen lighting spectrum, and a discharge-sustaining fill gas comprising a mixture of argon and neon sealed inside the light-transmissive glass envelope; and operating the at least one T8 fluorescent lamp at a preselected power level, wherein said lamp has a variance in correlated color temperature of not more than 300 degrees over an operating power level ranging from approximately 28 watts to approximately 57 watts.

20. The process of claim 19 wherein the preselected power level is at least 45 watts.

21. The process of claim 19 wherein the preselected power level is approximately 70 watts.

22. The process of claim 19 wherein the area lighted comprises one of a stage environment and a studio environment.

23. The process of claim 19 wherein said variance in correlated color temperature is not more than 200 degrees across said operating power level.

* * * * *